US006641248B2

(12) United States Patent
Mitsui et al.

(10) Patent No.: US 6,641,248 B2
(45) Date of Patent: Nov. 4, 2003

(54) INK JET PRINTER AND CAP DEVICE

(75) Inventors: Eiji Mitsui, Okazaki (JP); Takatoshi Takemoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 27 days.

(21) Appl. No.: 10/091,583

(22) Filed: Mar. 7, 2002

(65) Prior Publication Data

US 2002/0130917 A1 Sep. 19, 2002

(30) Foreign Application Priority Data

Mar. 8, 2001 (JP) ..... 2001-065309
Mar. 12, 2001 (JP) ..... 2001-068796

(51) Int. Cl.[7] ..... B41J 2/165
(52) U.S. Cl. ..... 347/29
(58) Field of Search ..... 347/14, 22, 23, 347/24, 29, 30, 32, 86

(56) References Cited

U.S. PATENT DOCUMENTS 6,203,136 B1 * 3/2001 Takahashi et al. ..... 347/32
6,491,370 B2 * 12/2002 Momose ..... 347/30
6,540,322 B2 * 4/2003 Usui et al. ..... 347/29

FOREIGN PATENT DOCUMENTS

| | | |
|---|---|---|
| EP | 0968 830 A2 | 1/2000 |
| JP | 2-029345 A | 1/1990 |
| JP | 2000-015826 A | 1/2000 |

* cited by examiner

*Primary Examiner*—Shih-wen Hsieh
(74) *Attorney, Agent, or Firm*—Oliff & Berridge, PLC

(57) ABSTRACT

A cap device is for capping a head of an ink jet printer. The cap device includes a cap, an ink absorption member, and a lid. The cap is for developing a seal around the ink ejection surface of the head. The ink absorption member is disposed in the cap to absorb ink that was ejected or sucked from the head into the cap. The lid covers an ink-ejection-surface-confronting portion of the ink absorption member, except at least a nozzle-confronting portion of the ink absorption member. The lid is connected to an inner peripheral surface of the cap with a fluidly tight connection.

16 Claims, 12 Drawing Sheets

INK JET PRINTER AND CAP DEVICE

BACKGROUND OF THE INVENTION

1. Field of the Invention

The present invention relates to an ink jet printer that ejects ink to form images on a recording medium and more particularly to an ink jet printer including an ink cartridge for holding ink supplied to the print head, the ink cartridge being formed with an atmosphere communication hole for easing supply of ink to the print head.

2. Description of the Related Art

One conventional ink jet printer has a cap unit with a sealing cap and an ink absorption member. The cap is for providing an intimate sealed condition around the ink ejection surface of the print head. A negative pressure can be applied in the space surrounded by the cap and the ink ejection surface while the cap sealingly covers the ink ejection surface. The negative pressure sucks ink from nozzles in the ink ejection surface of the print head. The cap can prevent ink from splattering around during flushing operations, wherein ink is forcibly ejected from the print head. The ink absorption member absorbs ink sucked out from or ejected from the print head so that ink can be prevented from overflowing out of the cap.

One type of known ink jet printer uses an ink cartridge that holds ink for supply to the print head. The print head ejects ink held in the ink cartridge in order to form images on a recording medium, such as a paper sheet. When ink in one ink cartridge is all used up, that ink cartridge is replaced with a new one so that image forming operations can be continued. Further, the ink cartridge can be provided with an atmosphere communication hole for easing supply of ink from the ink cartridge to the print head. By bringing the inside of the ink cartridge into fluid communication with atmosphere through the atmosphere communication hole, ink can be smoothly supplied from the ink cartridge to the print head so that blurry images and other problems related to unsmooth supply of ink can be prevented.

SUMMARY OF THE INVENTION

However, the above-described conventional configurations have problems. For example, ink can overflow from the cap even if an ink absorbing member is provided in the cap. That is, ink that was once absorbed by the ink absorbing member can overflow out of the cap. To overcome this problem it is conceivable that the ink in the ink absorption member be sucked out and collected using a pump, for example. However, even with this conceivable configuration, ink can still overflow from the cap if the ink absorption member absorbs an excessive amount of ink. Another potential remedy to the problem of ink overflow is to dispose the print head with its ink ejection surface facing directly downward and to dispose the cap with its open portion facing directly upward. However, this remedy only works if the ink jet printer itself is perfectly level on a flat surface. If the ink jet printer itself is oriented with a tilt, then both the ink ejection surface and the cap will tilt also. Also, this remedy limits freedom of design because in some situations it is desirable to design the ink jet printer so that the ink ejection surface is vertically oriented.

Providing an atmosphere communication hole to ink cartridges eases supply of ink, but also increases the risk of ink leaking from the print head. For example, ink can leak out of the print head when the ink jet printer is vibrated or shocked, for example by being carried around or otherwise transported. One potential remedy for this problem is to cover the print head with the above-described cap while the ink jet printer is transported. However, if the cap becomes separated from the print head because the ink jet printer is tilted at an angle, subjected to shock or vibration, or for some other reason, then ink will leak out from the print head. Therefore, merely covering the print head with the cap while transporting the ink jet printer is not a sufficient prevention for such ink leaks.

It is an objective of the present invention to provide a cap device capable of properly preventing ink from overflowing out from the cap of the cap device after the ink was sucked out or ejected from a print head of an ink jet printer into the cap. It is another objective of the present invention to provide an ink jet printer that uses ink cartridges formed with an atmosphere communication hole, but that does not leak ink when the ink jet printer is transported.

In order to achieve the above-described objectives, a cap device according to the present invention includes a cap, an ink absorption member, and a lid. The cap is for developing a seal around an ink ejection surface of a print head. The ink absorption member is disposed in the cap to absorb ink that was ejected or sucked from the print head into the cap. The lid covers an ink-ejection-surface-confronting portion of the ink absorption member except at least a nozzle-confronting portion of the ink absorption member. The lid is connected to an inner peripheral surface of the cap with a fluidly tight connection.

With this configuration, the lid, which is connected to the inner peripheral surface of the cap with a fluidly tight connection, covers the upper surface of the ink absorption member except at least the nozzle-confronting portion of the upper surface. For this reason, if the ink jet printer is used while the portion of the ink absorption member that is covered by the lid is disposed lower than the other portions, even if only because the cap and the ink absorption member are tilted slightly, the lid will dam up any potential flow of ink that is once absorbed the ink absorption member.

Accordingly, the cap device according to the present invention can properly prevent ink that was ejected from or sucked from the print head into the cap, from overflowing from the cap. It should be noted that the lid covers the ink absorption member except at the nozzle-confronting portion of the ink absorption member, nozzle flushing and suction operations can be performed properly in the conventional manner.

It is desirable that the lid covers the entire ink-ejection-surface-confronting portion of the absorption member except the nozzle-confronting portion of the ink absorption member. When the lid covers all of the upper surface of the ink absorption member except the nozzle-confronting portion, the lid properly dams up ink in the ink absorption member and can properly prevent ink from overflowing from the cap regardless of what direction the cap is tilted.

A cap device according to another aspect of the present invention also includes a cap, an ink absorption member, and a lid. In this case, the cap has a base and an inner peripheral surface. The base and the inner peripheral surface define an inner space and an open side of the cap. The open side is in confrontation with the base. The cap develops a seal around the ink ejection surface of the head when the cap is in intimate contact with the head while the head is located at the open side. The ink absorption member is disposed at the base of the cap to absorb ink that was ejected or sucked from the head into the cap from the open side of the cap. The ink absorption member has an upper surface facing the open side of the cap from inside the cap. The upper surface has an nozzle-confronting portion at a position that confronts the nozzles of the head when the cap is in an intimate seal with the ink ejection surface of the head. The lid covers the upper surface of the ink absorption member except at least the nozzle-confronting portion of the upper surface. The lid is connected to the inner peripheral surface of the cap with a fluidly tight connection.

An ink jet printer according to the present invention includes a head, a cap, an ink absorption member, and a lid. The head has an ink ejection surface formed with nozzles. The cap is for developing a seal around the ink ejection surface of the print head. The ink absorption member is disposed in the cap to absorb ink that was ejected or sucked from the print head into the cap. The lid covers an ink-ejection-surface-confronting portion of the ink absorption member except at least a nozzle-confronting portion of the ink absorption member. The lid is connected to an inner peripheral surface of the cap with a fluidly tight connection.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Figure 1:
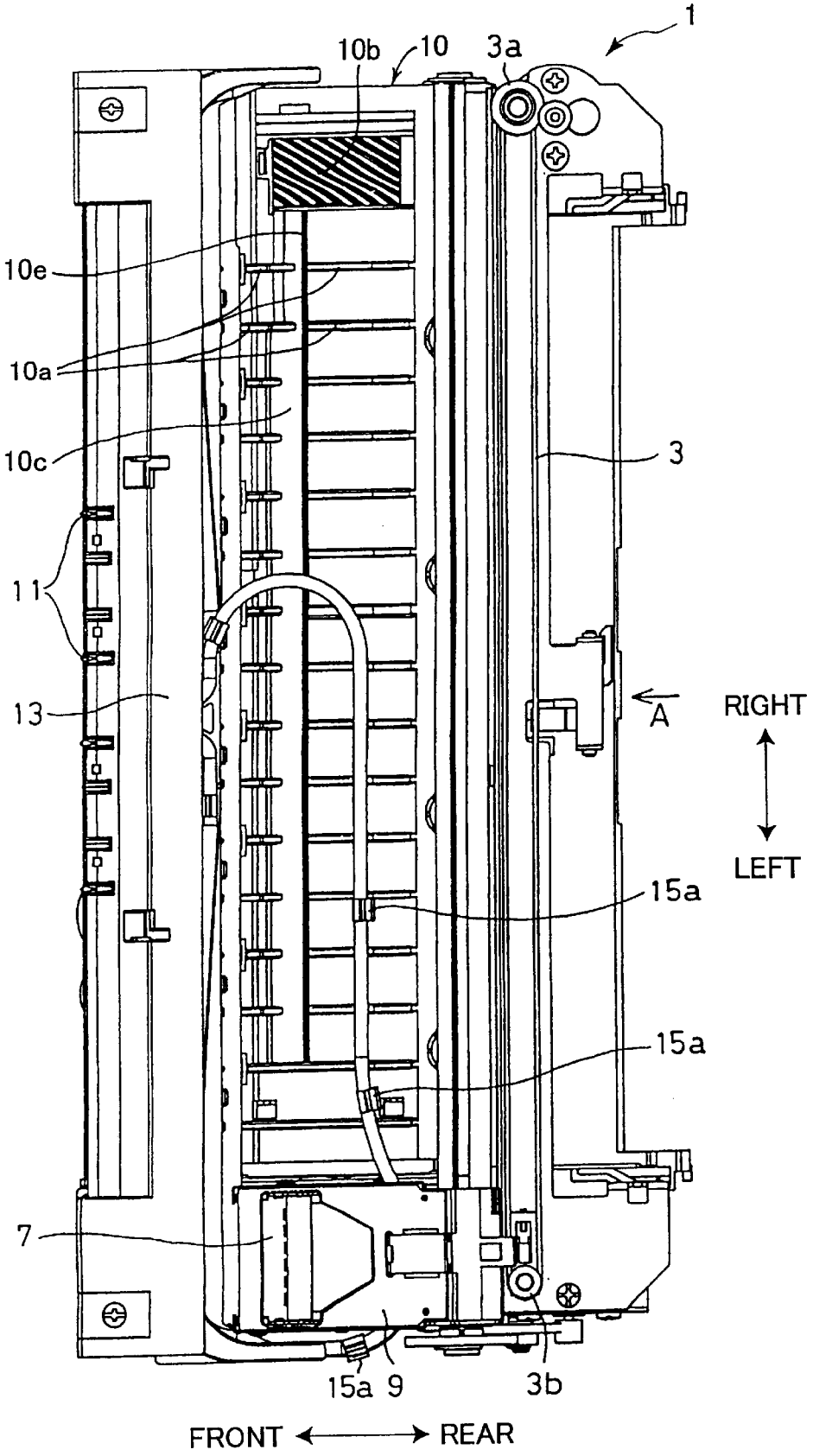
FIG. 1 is a plan view showing configuration around a platen of an ink jet printer according to an embodiment of the present invention.

An ink jet printer 1 according to an embodiment of the present invention will be described with reference to the attached drawings. Unless mentioned otherwise, directional terms such as up, down, left, and right will be used as indicated in the drawings.

Figure 5:
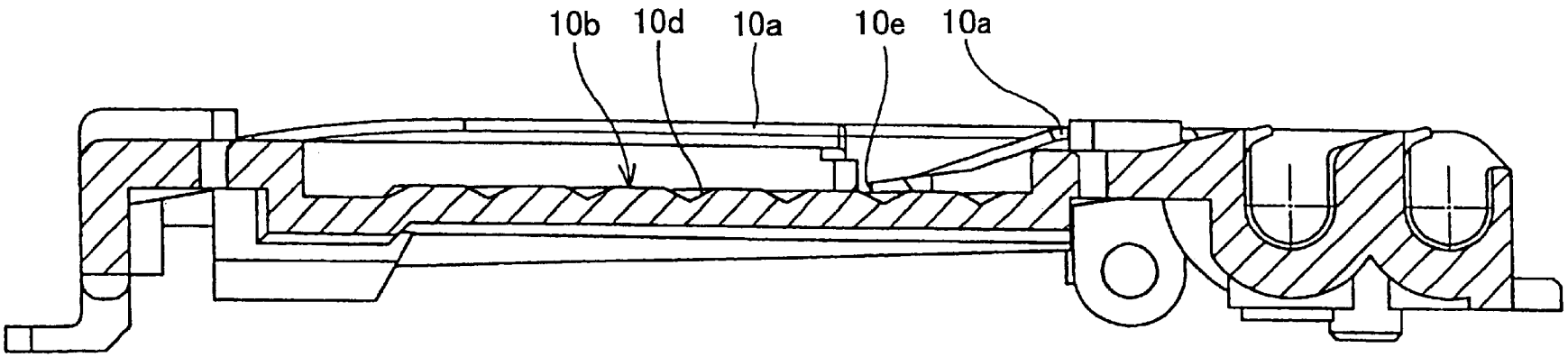
FIG. 5 is a cross-sectional view taken along line V=13 V of FIG. 2, showing only a plastic plate that configures the platen.

As shown in FIG. 1, the ink jet printer 1 includes a platen 10, a carriage 9, a print head 7 mounted on the carriage 9, a belt 3 and pulleys 3*a*, 3*b* for transporting the carriage 9 reciprocally left and right across the platen 10, sheet-discharge rollers 11*a*, and a lid 13. Although not shown in the drawings, upstream-side transport rollers are provided for transporting sheets in a sheet transport direction A from front to rear across the platen 10. The upstream-side transport rollers are provided upstream from the platen 10 with respect to the sheet transport direction A. Two downstream-side transport rollers, whose rotational axes are indicated by crossed lines in FIG. 5, are disposed downstream from the platen 10 separated from each other in the front-rear direction.

The platen 10 is formed at its surface with a plurality of parallels aligned ribs 10*a* for receiving the recording sheets.

The belt 3 is disposed at a position to the rear of the platen 10 and spans across substantially the entire printer from left to right in the widthwise direction of sheets transported across the platen 10. The belt 3 is wrapped around the pulleys 3*a*, 3*b*. Pulley 3*a* is a drive pulley driven by a carriage motor 5 shown in FIG. 3 and pulley 3*b* is a follower pulley. The carriage 9 is fixed onto the belt 3 and, as described above, the print head 7 is mounted on the carriage 9. With this configuration, the drive force from the carriage motor 5 transports the carriage 9 leftward and rightward from one end of the platen 10 to the other and back. As the carriage 9 is transported in this manner, the print head 7 ejects ink onto the sheet supported by the platen 10, to form images on the recording sheet. The recording sheet formed with images is further transported by the downstream-side transport roller and then stacked onto a sheet-discharge tray (not shown) by the sheet-discharge roller 11.

Figure 2:
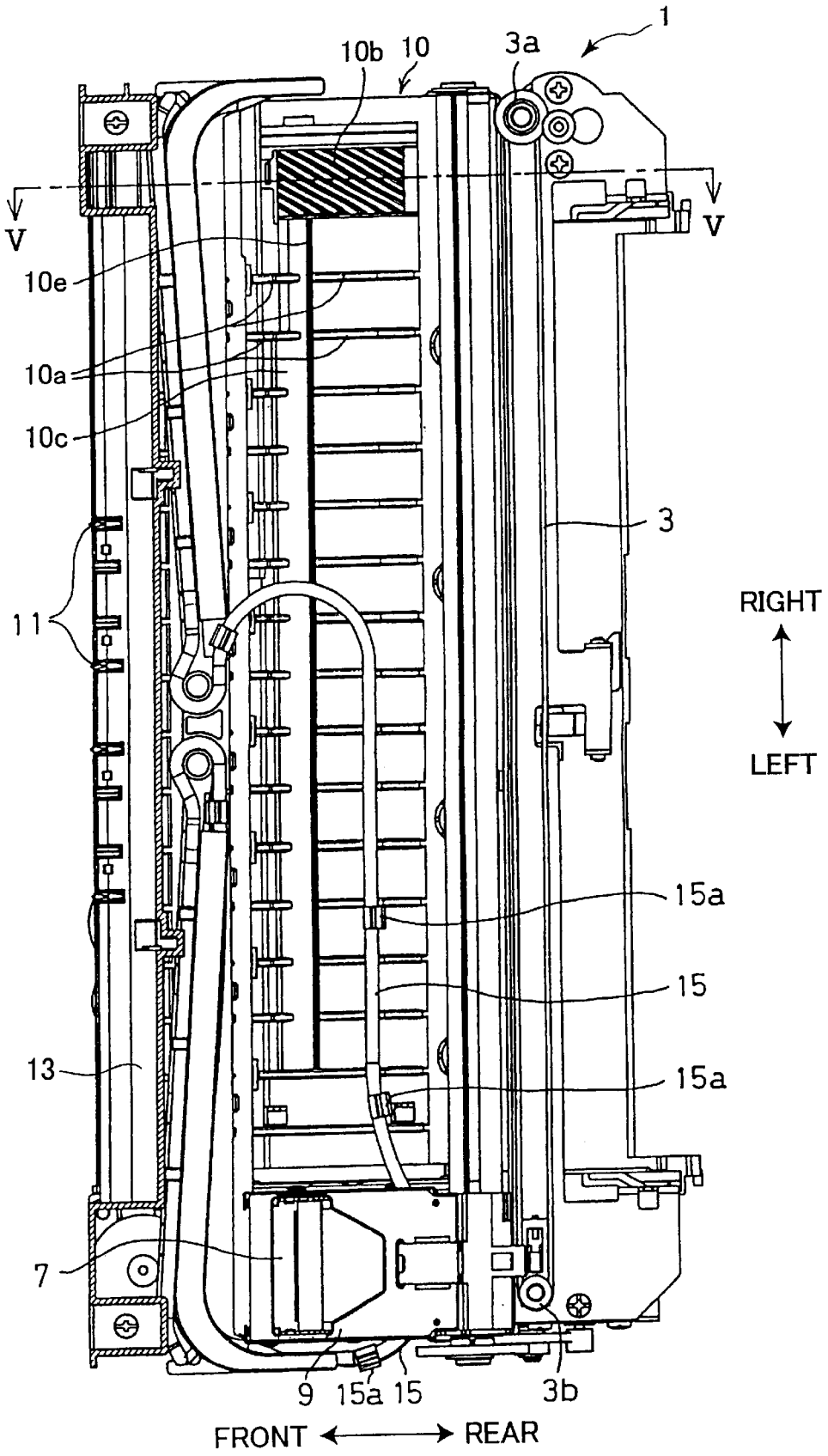
FIG. 2 is a plan view similar to FIG. 1, but with a section of a cover near sheet-discharge rollers removed.

FIG. 2 is a plan view similar to FIG. 1, but with a section of the cover 13 near the sheet-discharge rollers 11 removed. As shown in FIG. 2, left and right tube pairs 15 for supplying ink extend from the left and right sides of the print head 7, respectively. Although not visible in the drawings, both of the left and right tube pairs 15 include two tubes each that overlap on top of each other and that are bound together by clasps 15*a*. Both of the left and right tube pairs 15 extend to the front center of the platen 10. The left tube pair 15 then bends leftward and extends downward at the left front end of the platen 10. The right tube pair 15 bends rightward and extends downward at the right front end of the platen 10.

Figure 3:
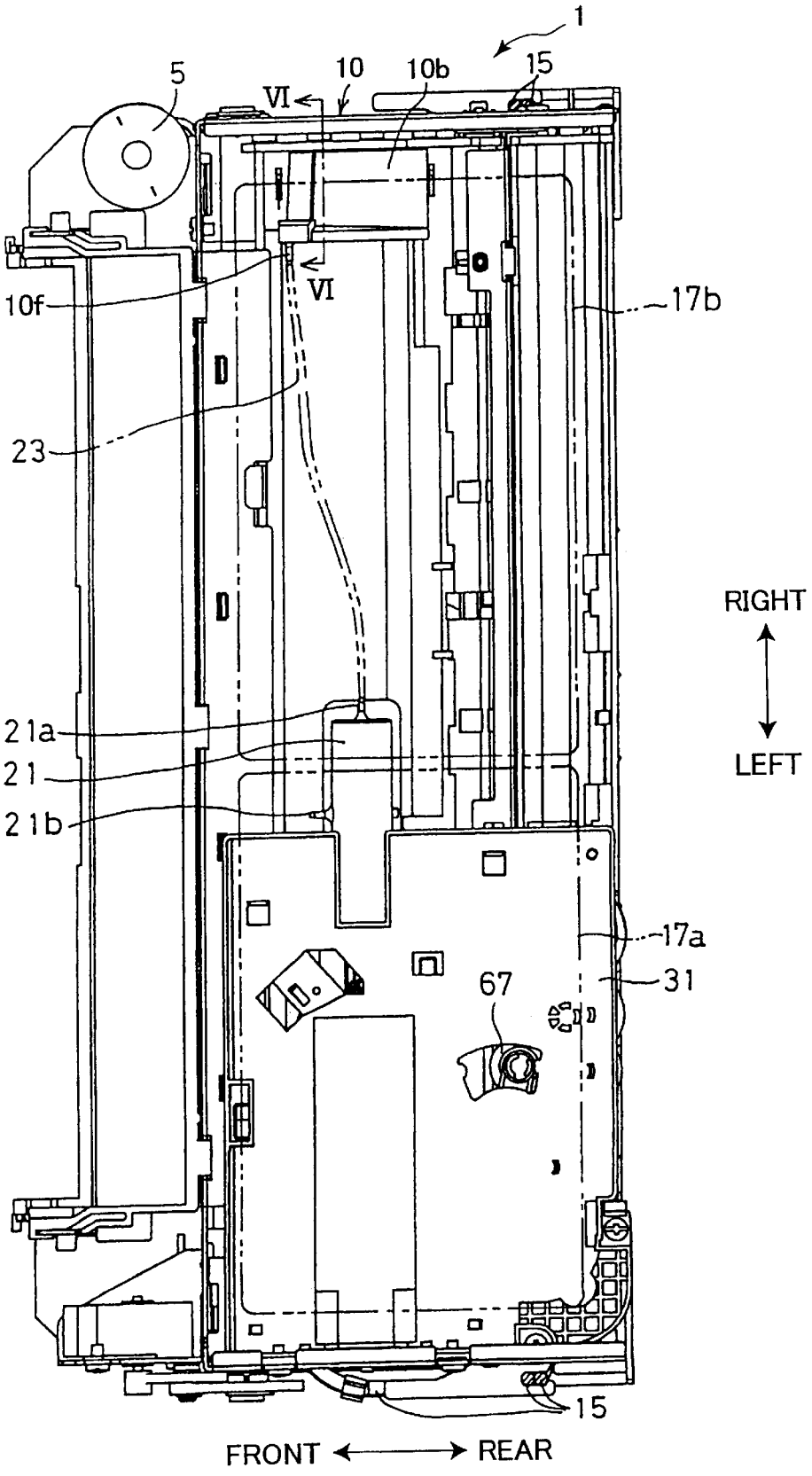
FIG. 3 is an underside view showing the underside of the ink jet printer of FIG. 1.
Figure 4:
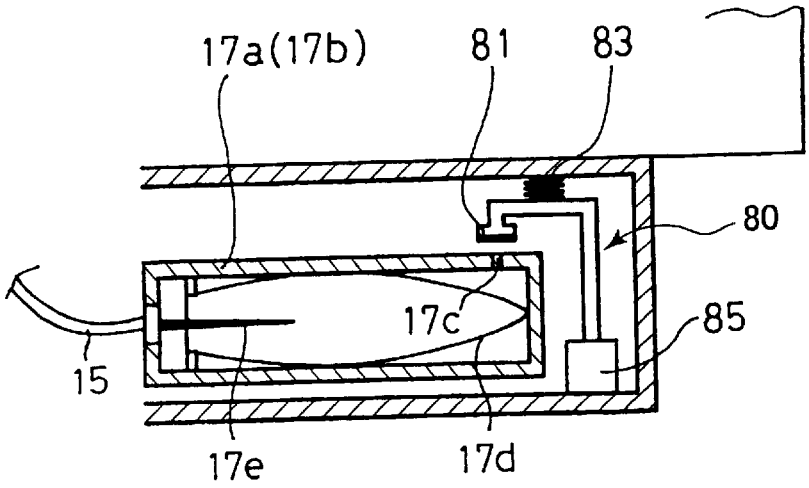
FIG. 4 is a cross-sectional view showing configuration in the vicinity of an ink cartridge of the ink jet printer of FIG. 1.

FIG. 3 is an underside view of the ink jet printer 1. As indicated in two-dot chain in FIG. 3, ink cartridges 17*a*, 17*b* are disposed below the platen 10. As shown in FIG. 4, each of the ink cartridges 17*a*, 17*b* includes a rigid housing (cartridge case), two flexible ink-holding bags 17*d*, only one of which is shown in the drawings, and hollow needles 17*e*. The rigid housing houses the two flexible ink-holding bags 17*d*. The ink cartridge 17*a* includes magenta and yellow ink-holding bags 17*d* that hold magenta and yellow ink, respectively, and the ink cartridge 17*b* includes cyan and black ink-holding bags 17*d* that hold cyan and black ink, respectively. The rigid casing of each of the ink cartridges 17*a*, 17*b* is formed with an atmosphere communication hole 17*c* for bringing the interior of the rigid casing into communication with atmosphere. Each tube of the left and right tube pairs 15 is connected, via the hollow needles 17*e*, to a different one of the magenta, yellow, cyan, and black ink-holding bags 17*d* at a position under the front end of the platen 10. The print head 7 can form desired color images on the recording sheets by ejecting, as needed, ink supplied from the different ink holding portions. While the atmosphere communication hole 17*c* is opened up, ink is supplied from each ink-holding bag 17*d* to the print head 7 through the hollow needles 17*e* and the corresponding tube 15.

Figure 6:
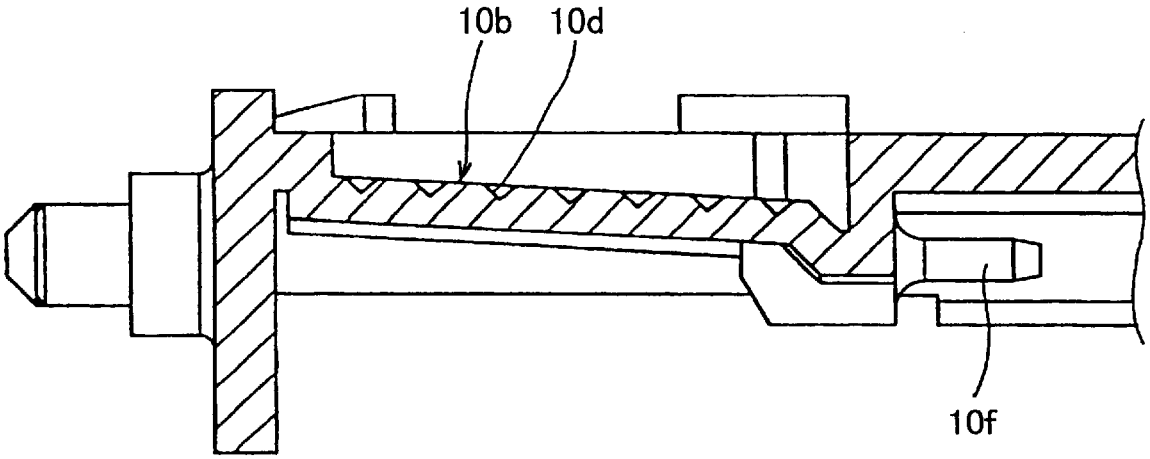
FIG. 6 is a cross-sectional view taken along line VI=13 VI of FIG. 3.

Returning to FIG. 2, the ink jet printer 1 is provided with a groove 10*e*, overshoot ink reception portions 10*c*, and the flushing ink receptacle 10*b*. The groove 10*e* and the overshoot ink reception portions 10*c* are formed in gaps formed in the ribs 10*a* near where ink is ejected from the print head 7. The overshoot ink reception portions 10*c* catch ink that misses the recording sheet when sheets are printed up to the very edge of sheets, that is, with no blank margin at the edge portions. When a sheet is printed up to the edge, only a portion of the nozzles in the front side of the print head 7 are driven and ink is ejected toward edges in the sheet-transport direction or edges in the widthwise direction of the sheets. The groove 10*e* leads to the flushing ink receptacle 10*b*. The surface of the overshoot ink reception portions 10*c* is machined to a rough finish so that ink ejected onto the surface of the overshoot ink reception portions 10*c* is drawn by capillary action into the groove 10*e* and flows toward the flushing ink receptacle 10*b*. The flushing ink receptacle 10*b* is formed at a position that confronts the print head 7 when the print head is located at the right-hand end of the platen 10. The flushing ink receptacle 10*b* receives ink from the groove 10*e* and ink that is ejected from the print head 7 during a flushing operation. As shown in FIGS. 5 and 6, the flushing ink receptacle 10*b* is formed with a plurality of grooves 10*d*. Ink is adsorbed by capillary action generated in the grooves 10*d*.

As shown in FIGS. 3 and 6, a tube connector 10*f* is formed below the flushing ink receptacle 10*b*. As shown in FIG. 6, the entire flushing ink receptacle 10*b* slants toward the tube connector 10*f*. As shown in FIG. 3, a tube 23 connects the tube connector 10*f* to a tube connector 21*a* of a pump 21. The pump 32 operates to suck, through the tube 23, ink that has accumulated in the flushing ink receptacle 10*b* and discharge the ink out through the tube connector 21*b*.

The ink that was discharged from the tube connector 21*b* is transported to waste ink collecting portions of the ink cartridges 17*a*, 17*b* through a tube (not shown). The waste ink collecting portions of the ink cartridges 17*a*, 17*b* are in fluid communication with each other. It should be noted that the ink holding portions and the waste ink collecting portions of the ink cartridges 17*a*, 17*b* have well-known configurations disclosed, for example, in European Patent Application EP 0 968 830 A2 and Japanese Patent Publication No. 2-29345, so their detailed explanation will be omitted.

Figure 7:
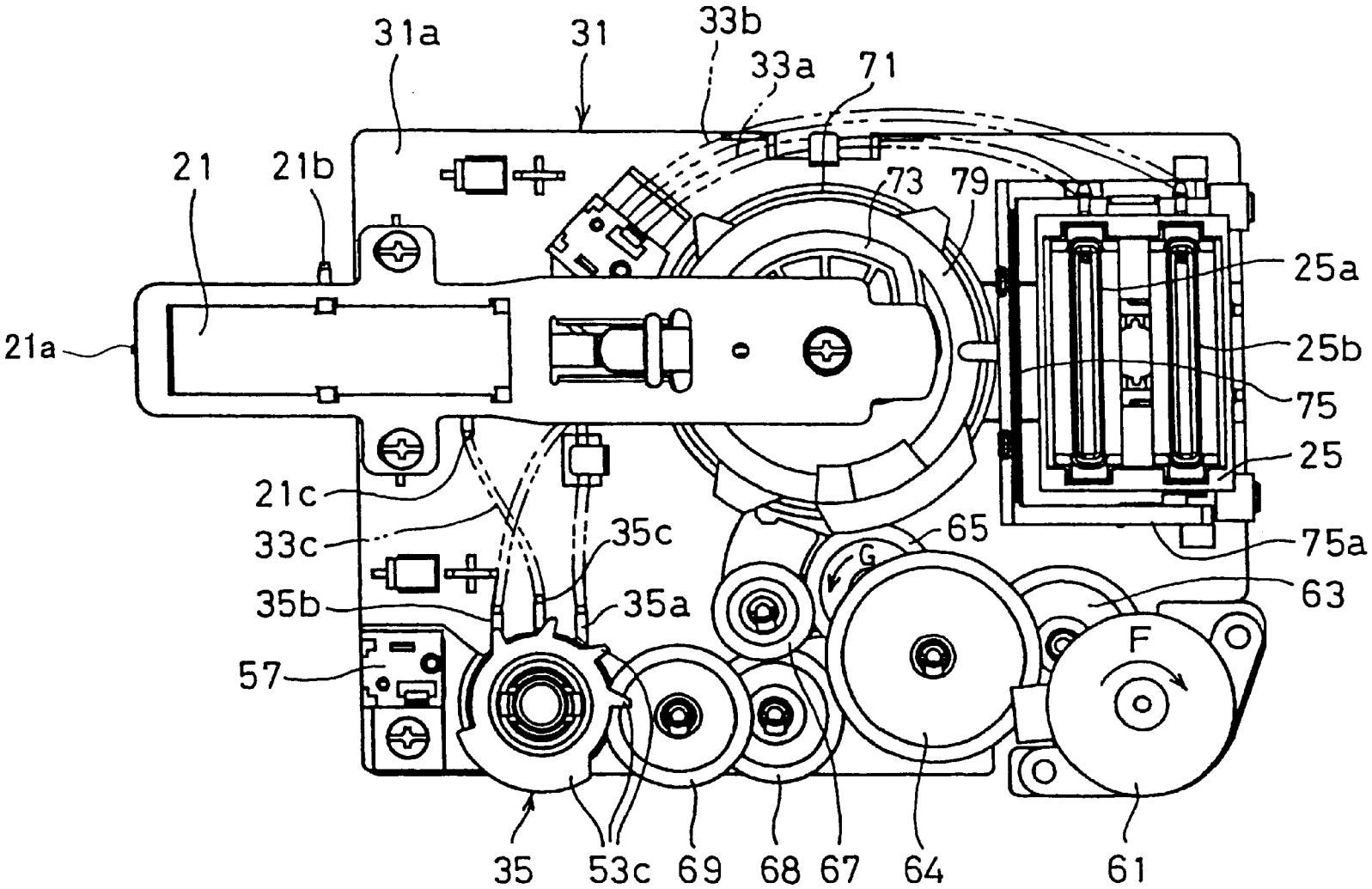
FIG. 7 is a plan view showing a maintenance device of the ink jet printer of FIG. 1.

As shown in FIG. 3, a maintenance device 31 is provided at the left end of the platen 10, in confrontation with the position of the print head 7 shown in FIGS. 1 and 2. As shown in FIG. 7, the maintenance device 31 includes a cap unit 25, the pump 21, a maintenance motor 61, a drive transmission system of gears 64 to 69, a cam gear 71, a switching unit 35, and a wiper unit 75.

Figure 15:
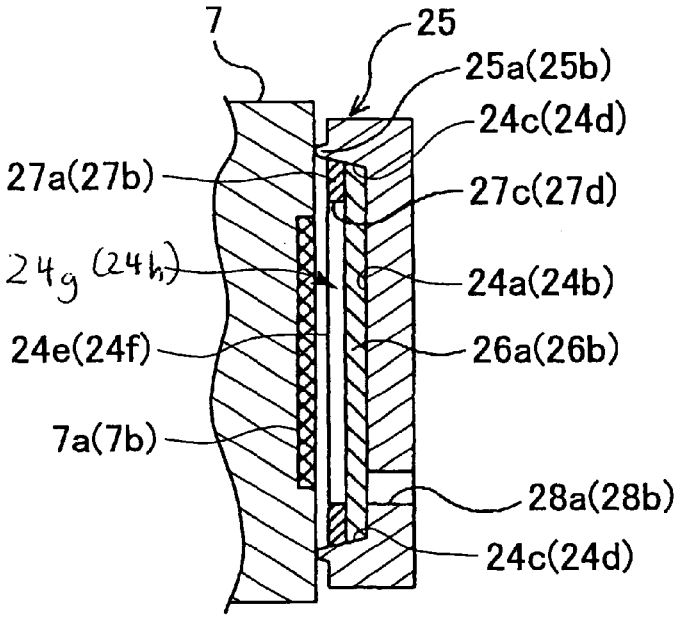
FIG. 15 is a cross-sectional view showing the cap unit and print head of FIG. 14.

The cap unit 25 includes a pair of integral caps 25*a*, 25*b*, ink absorption members 26*a*, 26*b*, lids 27*a*, 27*b*, and suction ports 28*a*, 28*b*. As shown in FIG. 15, the caps 25*a*, 25*b* each have a base 24*a*, 24*b* and inner lateral walls 24*c*, 24*d* defining an inner space 24*g*, 24*h* and an open side 24*e*, 24*f*. The open side 24*e*, 24*f* is in confrontation with the base 24*a*, 24*b*. The caps 25*a*, 25*b* develop a seal around the ink ejection surface of the print head 7 when the print head 7 is located at the open side 24*e*, 24*f* and the caps 25*a*, 25*b* are in intimate contact with the print head 7 as shown in FIG. 15. The inner space 24*g*, 24*h* of each cap 25*a*, 25*b* can also be said to be encompassed by the cap 25*a*, 25*b* and the ink ejection surface of the print head 7.

The ink absorption members 26*a*, 26*b*, are provided in the caps 25*a*, 25*b*. The lids 27*a*, 27*b* are connected integrally with an inner peripheral surface of the cap to make a fluidly tight connection and are provided for covering the upper surface of the ink absorption members 26*a*, 26*b*, except where the ink absorption members 26*a*, 26*b* are in confrontation with the nozzles of the print head 7. Detailed description of the cap unit 25 will be provided later.

The switching unit 35 includes tube connectors 35*a*, 35*b*, and 35*c*. The tube connectors 35*a* and 35*b* are connected to the inner spaces 24*g*, 24*h* of the caps 25*a*, 25*b* through tubes 33*a*, 33*b* and the suction ports 28*a*, 28*b*. The tube connector 35*c* is connected to a tube connector 21*c* of the pump 21 through a tube 33*c*. The switching unit 35 functions to bring the interior of the tubes 33*a*, 33*b* (the caps 25*a*, 25*b*) or the tube 33*c* (the pump 21) into fluid communication with atmosphere and to bring the tube 33*a* (the cap 25*a*) or the tube 33*b* (the cap 25*b*), or both of the tubes 33*a*, 33*b* (caps 25*a*, 25*b*), into fluid communication with the tube 33*c* (the pump 21). When the tube 33*a* or the tube 33*b*, or both of the tubes 33*a*, 33*b*, are in fluid communication with the tube 33*c*, the pump 21 can apply a negative pressure to the space in the corresponding cap 25*a*, 25*b*.

Figure 8:
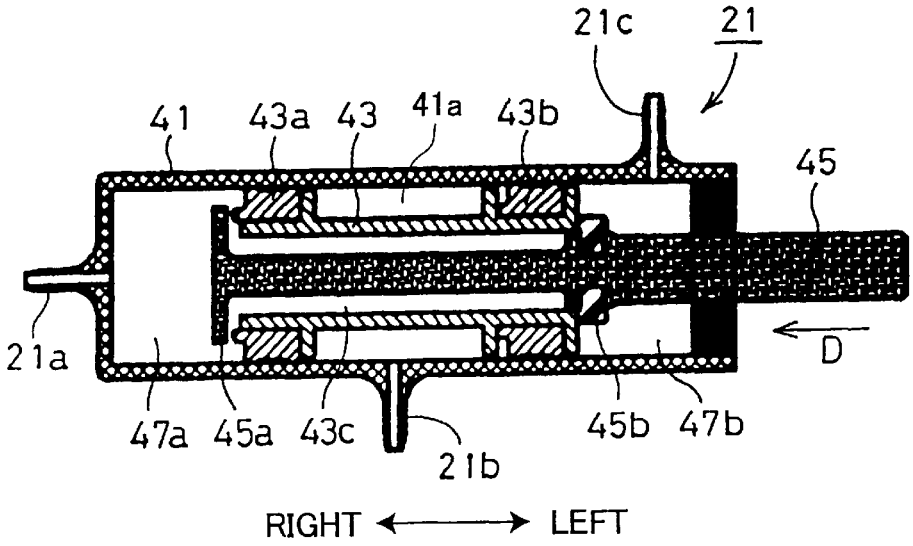
FIG. 8 is a cross-sectional view showing a suction pump of the maintenance device.

As shown in FIG. 8, the pump 21 includes a cylinder 41 and a piston 43. The piston 43 is freely slidably provided in the hollow center of the cylinder 41. A pair of rubber rings 43*a*, 43*b* are fitted to the outer periphery of the piston 43. The rubber ring 43*a* is positioned at the right end, and the rubber ring 43*b* is fitted at the left end of the piston 43. The rubber rings 43*a*, 43*b* abut the inner wall surface of the cylinder 41 to create an air-tight seal around the outer periphery of the rubber rings 43*a*, 43*b*. A rod 45 extends through the center of the piston 43. A flange portion 45*a* is formed at the right end of the rod 45. A rubber ring 45*b* is fitted around the outer periphery of the rod 45. The flange portion 45*a* and the rubber ring 45*b* softly sandwich the piston 43 therebetween from opposite ends of the piston 43. Although not shown in the drawings, a hole brings a space 41*a*, which is defined between the cylinder 41, the outer periphery of the piston 43, and the pair of rubber rings 43*a*, 43*b*, into fluid communication with a central hollow space 43*c* of the piston 43. Negative pressure chambers 47*a*, 47*b* are located at the right and left ends, respectively, of the piston 43.

When the rod 45 is moved rightward as indicated by arrow D in FIG. 8, then the rubber ring 45*b* is compressed against the piston 43 so that a gap opens up between the flange 45*a* and the piston 43/rubber ring 43*a*. As a result, a negative pressure is generated in the negative pressure chamber 47*b* at the left end of the piston 43, in association with movement of the rod 45. On the other hand, fluid inside the negative pressure chamber 47*a* at the front end of the piston 43 flows into the central hollow portion 43*c* through the gap, then into the space 41*a* through the hole in the piston 43, and is discharged from the tube connector 21*b*.

In the opposite situation, when the rod 45 is pulled back leftward, then the flange 45*a* compresses the rubber ring 43*a* so that a gap opens between the rubber ring 45*b* and the piston 43. As a result, a negative pressure develops in the pressure chamber 47*a* at the right end of the piston 43, in association with movement of the rod 45. On the other hand, the fluid in the negative pressure chamber 47*b* at the left side of the piston 3 flows through the gap into the hollow space 43*c*, then is discharged from the tube connector 21*b*. In this way, the pump 21, by reciprocal movement of the rod 45, functions to suck fluid from the tube connectors 21*a*, 21*c* in alternation and functions to discharge ink from the tube connector 21*b*.

Figure 9:
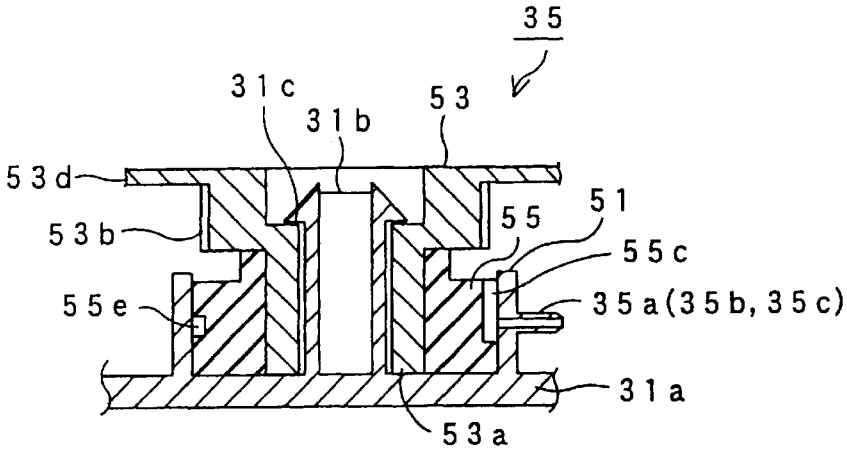
FIG. 9 is a vertical cross-sectional view showing a switching unit of the maintenance device.

As shown in FIG. 9, the switching unit 35 includes an outer tube 51, a rotational shaft 31*b*, an inner tube 53, and a rubber member 55. The outer tube 51 is formed from plastic integrally with the base plate 31*a* of the maintenance device 31. The rotational shaft 31*b* is provided with an upright posture on the base plate 31*a*. The inner tube 53 is provided freely-rotatable around the rotational shaft 31*b*. The rubber member 55 is mounted on the outer periphery of the inner tube 53 and rotates integrally with the inner tube 53. The tube connectors 35*a* to 35*c* are provided extending outward from the outer tube 51. The interior of the tube connectors 35*a* to 35*c* are opened through to the internal side wall of the outer tube 51.

Figure 10:
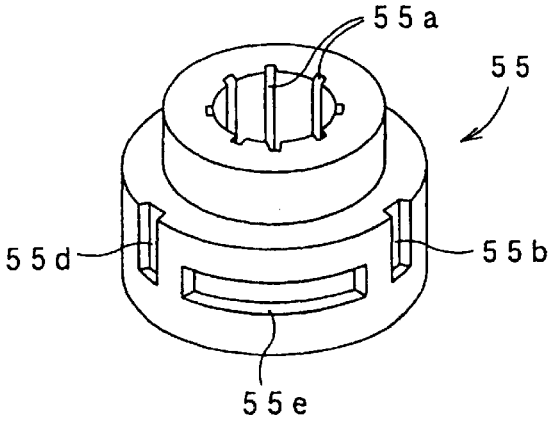
FIG. 10 is a perspective view showing a rubber member of the switching unit.

The rotational shaft 31*b* is formed at its free end with holding pawls 31*c* for preventing the inner tube 53 from falling off from the rotational shaft 31*b*. The holding pawls 31*c* can protrude and retract by resilient deformation. The inner cylinder 53 includes an engaging portion 53*a*, a gear portion 53*b*, and a cam plate 53*d*, in this order starting with the component nearest to the base plate 31*a* and moving upward. Each of the engaging portion 53*a*, the gear portion 53*b*, and the cam plate 53*d* is formed from an integral piece of plastic. As shown in FIG. 10, the rubber member 55 is formed with vertical grooves 55*a* at its inner surface. The engagement portion 53*a* engages in the vertical grooves 55*a* of the rubber member 55 so that the inner tube 53 rotates integrally with the rubber member 55. The gear portion 53*b* is a spur gear exposed above the rubber member 55. The cam plate 53*d* includes a plurality of pawls 53*c* shown in FIG. 7. The pawls 53*c* are for operating a limit switch 57 shown in FIG. 7.

Figure 11:
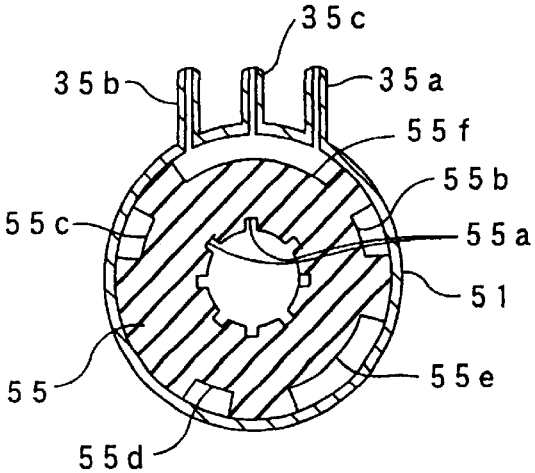
FIG. 11 is a cross-sectional view showing the switching unit.

As shown in FIGS. 10 and 11, the rubber member 55 is formed at its outer periphery with open grooves 55*b*, 55*c*, 55*d* and connection grooves 55*e*, 55*f*. The open grooves 55*b*, 55*c*, 55*d* are opened in the rubber member 55 at positions level with the tube connectors 35*a* to 35*c* and that extend upward into communication with atmosphere. Therefore, by bringing one of the tube connectors 35*a* to 35*c* into confrontation with one of the opened groves 55*b* to 55*d*, then the interior of the confronting tube connector 35*a* to 35*c* can be brought into fluid communication with atmosphere. The connection grooves 55*e*, 55*f* are formed elongated in the lateral direction so as to be capable of confronting a plurality of the tube connectors 35*a* to 35*c* simultaneously. More specifically, the connection groove 55*e* is formed long enough to simultaneously confront two of the three tube connectors 35*a* to 35*c* and the connection groove 55*f* is formed long enough to simultaneously confront all three of the tube connectors 35*a* to 35*c*. By bringing two or three of the tube connectors 35*a* to 35*c* simultaneously into confrontation with the connection grooves 55*e*, 55*f*, the two or three tube connectors 35*a* to 35*c* can be brought into fluid communication with themselves. The open groove 55*b* is formed at a position that confronts the tube connector 35*b* when the connection groove 55*e* confronts the tube connectors 35*a*, 35*c*. The open groove 55*d* is formed at a position that confronts the tube connector 35*a* when the connection groove 55*e* confronts the tube connectors 35*b*, 35*c*. The open groove 55*c* is formed at a position that confronts the tube connector 35*c* when the tube connector 35*b* confronts the open groove 55*d*. The tube connectors 35*a*, 35*b* confront the connection grooves 55*e*, 55*f* when the tube connector 35*c* confronts the open groove 55*b*.

When a portion of the external wall of the rubber member 55 that is not formed with the open grooves 55*b* to 55*d* or the connecting grooves 55*e*, 55*f* confronts one of the tube connectors 35*a* to 35*c*, then the interior of the confronted one of the tube connectors 35*a* to 35*c* is tightly sealed. In this way, the switching unit 35 can switch, the tube connectors 35*a* to 35*c* into fluid communication with each other or with atmosphere, or into a sealed condition, by rotating the rubber member 55 using the gear portion 53*b* of the inner tube 53.

Returning to FIG. 7, an explanation will be provided for the drive system for the pump 21 and the switching unit 35. The maintenance motor 61 is fixed to the base plate 31*a*. The rotation of the motor 61 is transmitted to a sun gear 65 via deceleration gears 63 and 64. When the motor 61 is rotated in the direction indicated by arrow F in FIG. 7, then the sun gear 65 rotates in the direction indicated by arrow G in FIG. 7. The sun gear 65 is meshingly engaged with a planetary gear 67. The planetary gear 67 swings in the direction indicated by arrow G in association with rotation of the sun gear 65, into meshing engagement with a gear 68. As a result, rotation of the gear 68 is transmitted to the gear portion 53*b* shown in FIG. 9 via a gear 69 so that the inner tube 53 and the rubber member 55 can be rotated by drive of the motor 61.

On the other hand, when the maintenance motor 61 is rotated in the direction opposite from the direction indicated by arrow F, then the planetary gear 67 swings in the direction opposite from the direction indicated by arrow G into meshing engagement with a cam gear 71. The upper surface of the cam gear 71 is formed with cam grooves 73. The cam grooves 73 engage with a pin (not shown) formed on the rod 45 of the pump 21 so that rotation of the cam gear 71 reciprocally moves the rod 45.

Figure 12:
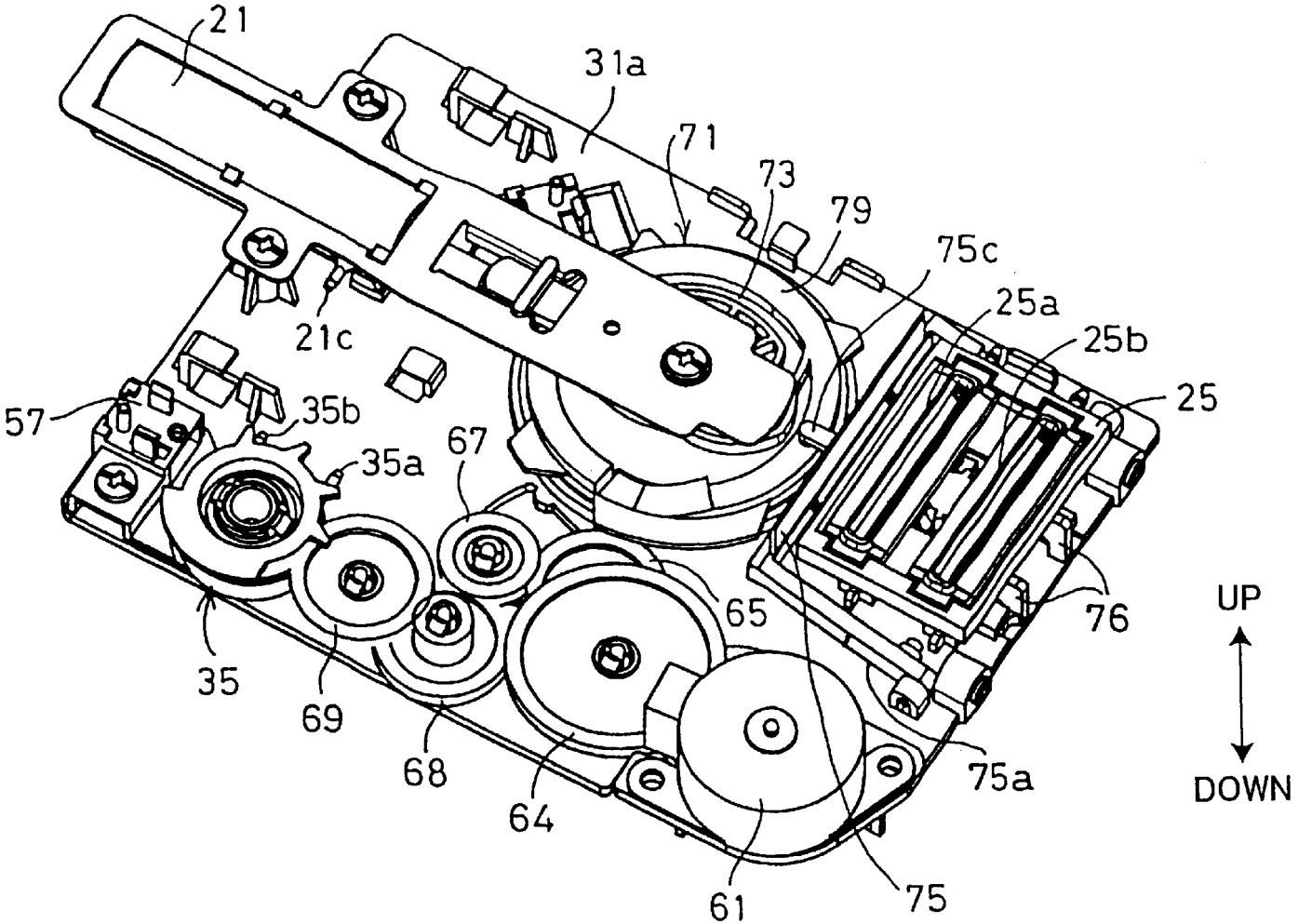
FIG. 12 is perspective view showing the maintenance device.

As shown in FIG. 12, the wiper unit 75 is vertically movable via a link 75*a*. A pin 75*c* is formed on the wiper unit 75. A cam surface 79 is formed at the outer peripheral section on the upper surface of the cam gear 71. The pin 75*c* is supported on the cam surface 79 and moves vertically in association with the cam surface 79. The wiper unit 75 in turn moves vertically up and down in association with the vertical movement of the pin 75*c*.

Sliders 76 are provided for moving the cap unit 25 up and down. Although not shown in the drawings, a cam groove is formed in the underside surface of the cam gear 71 and a pin that abuts against the cam groove is formed on the sliders 76. The sliders 76 are moved up and down by the cam groove via the pin, thereby moving the cap unit 25 up and down. When the print head 7 is positioned at the left side of the platen 10 as shown in FIG. 1, this upward movement of the cap unit 25 brings the caps 25*a*, 25*b* into intimate sealed contact with the ink ejection surface of the print head 7 so that, as shown in FIG. 15, nozzle regions 7*a*, 7*b* of the print head 7 are sealed within the inner spaces 24*g*, 24*h* of the caps 25*a*, 25*b*.

Next, an explanation will be provided for operation of the maintenance device 31. While the ink ejection surface of the print head 7 is sealed by the caps 25*a*, 25*b*, the inner tube 53 and the rubber member 55 are rotated until the tube connectors 35*a*, 35*b* are brought into confrontation with the open grooves 55*c*, 55*d*. Next, the cam gear 71 is rotated to raise the cap unit 25 via the cam groove (not shown) and the sliders 76 so that the ink ejection surface is sealed by the caps 25*a*, 25*b*. At this time, the inner spaces 24*g*, 24*h* in the caps 25*a*, 25*b* is opened to atmosphere. Therefore, no pressure will be applied to the nozzles of the ink ejection surface when the caps 25*a*, 25*b* abut against the ink ejection surface, so that adverse effects to the nozzles, such as disturbance of the ink meniscus, can be avoided.

If, while in this condition, the connection groove 55*e* brings the tube connector 35*c* into fluid communication with one of the tube connectors 35*a* or 35*b*, then the pump 21 can apply a negative pressure in the inner space 24*g*, 24*h* of the corresponding cap 25*a* or 25*b* so that ink can be sucked out from the corresponding nozzles of the ink ejection surface of the print head 7.

It should be noted that although nozzles surrounded by only one of the caps 25*a*, 25*b* are suctioned at a time according to the present embodiment, ink can be sucked from the nozzles surrounded by both caps 25*a*, 25*b* simultaneously by bringing all of the tube connectors 35*a*, 35*b*, and 35*c* into fluid communication with each other through the connection groove 55*f* and applying a negative pressure to the spaces encompassed by the ink ejection surface and both of the caps 25*a*, 25*b*. The other tube connector 35*a* or 35*b*, which is not presently involved in a suction operation, will be located in confrontation with either the open groove 55*b* or the open groove 55*d*, and thus in fluid communication with atmosphere. As a result, even if suction operations are repeatedly performed while moving the caps 25*a*, 25*b* into and out of intimate contact with the ink ejection surface of the print head 7 by moving the cap unit 25 vertically up and down, the nozzles in confrontation with the non-sucked cap 25*a* or 25*b* will not be adversely effected because the non-sucked cap 25*a* or 25*b* is in fluid communication with atmosphere.

By sucking ink from the nozzles in this way, the performance of the print head 7 can be properly maintained. Moreover, the ink jet printer is capable of optionally switching the caps 25*a*, 25*b* into fluid communication with the pump 21 or with atmosphere, or into a sealed condition, so that suction operations can be performed in an appropriate manner.

Figure 13:
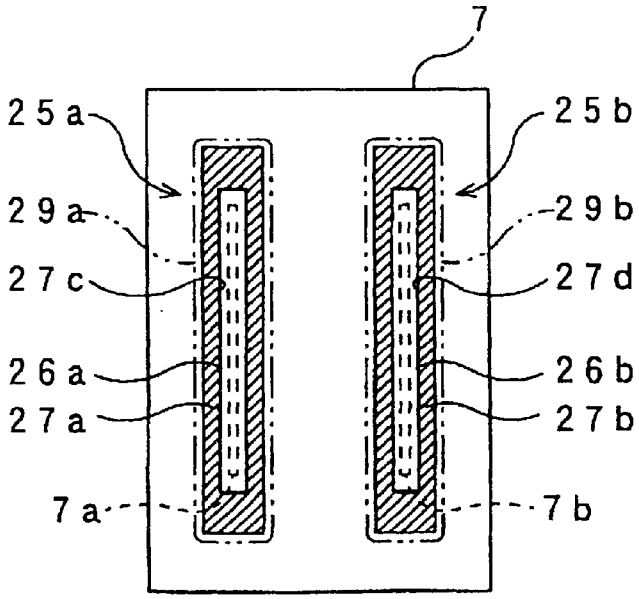
FIG. 13 a front view schematically showing positional relationship of the components of cap unit of the maintenance device and a print head.
Figure 14:
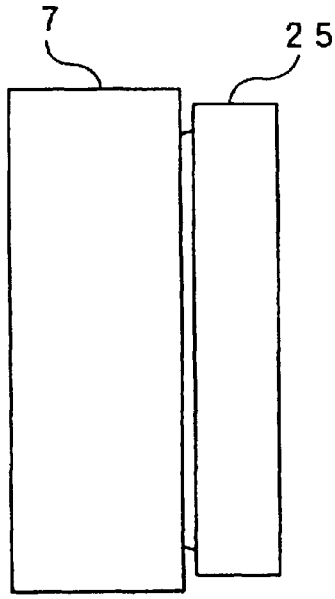
FIG. 14 is a side view showing the cap unit in sealing intimate contact with the print head.

Next, an explanation for the configuration of the cap unit 25 will be provided with reference to FIGS. 13 to 15. FIGS. 13 to 15 show the condition of the caps 25*a*, 25*b* assuming that the ink jet printer 1 is being used turned on its side, with the discharge rollers 11 located at the upper part of the ink jet printer 1. As mentioned previously, the cap unit 25 includes the caps 25*a*, 25*b*, ink absorption members 26*a*, 26*b*, lids 27*a*, 27*b*, and suction ports 28*a*, 28*b*.

The ink absorption members 26*a*, 26*b* are provided in the caps 25*a*, 25*b* for the purpose of absorbing ink that was ejected or sucked from the print head 7 into the caps 25*a*, 25*b* from the open side of the caps 25*a*, 25*b*. The ink absorption members 26*a*, 26*b* are formed from foam that fills the entire base of the caps 25*a*, 25*b*. The upper surface of the ink absorption members 26*a*, 26*b*, which faces the open side of the caps 25*a*, 25*b* from inside the caps 25*a*, 25*b*, has a nozzle-confronting portion at a position that confronts the nozzles of the print head 7 when the caps 25*a*, 25*b* are in an intimate seal with the ink ejection surface of the print head 7.

The lids 27*a*, 27*b* are fluidly sealingly connected with an inner wall surface around the entire inner periphery of the caps 25*a*, 25*b* and extend over the tops of the ink absorption members 26*a*, 26*b* in a stacked condition on the ink absorption members 26*a*, 26*b*. As shown in FIG. 13, the lids 27*a*, 27*b* are formed with hole portions 27*c*, 27*d* at a nozzle-confronting portion at the upper surface of the ink absorption members 26*a*, 26*b*. The suction ports 28*a*, 28*b* are provided at a position near and under the ink absorption members 27*a*, 26*b* when the ink jet printer is disposed with an upright posture as in the present example.

The caps 25*a*, 25*b* with this configuration achieve the following results. When the pump 21 is operated to perform an ink suction operation, ink sucked from the nozzles first impinges on the upper surface of the ink absorption members 26*a*, 26*b* through the hole portions 27*c*, 27*d* and is absorbed by the ink absorption members 26*a*, 26*b*. Then, the ink is sucked from the ink absorption members 26*a*, 26*b* through the suction ports 28*a*, 28*b* and collected in the negative pressure chamber 47*b* of the pump 21.

When the ink absorption members 26*a*, 26*b* are required to absorb a great deal of ink, the ink absorption members 26*a*, 26*b* may not be able to hold the ink before the ink is sucked out of the ink absorption members 26*a*, 26*b* through the suction ports 28*a*, 28*b* and collected in the negative pressure chamber 47*b* of the pump 21. If the lids 27*a*, 27*b* were not provided, then the ink would overflow from the downward end of the ink absorbing members 26*a*, 26*b*. However, the lids 27*a*, 27*b* of the ink jet printer according to the present invention dam up the ink so that ink overflow from the caps 25*a*, 25*b* can be properly prevented. Also, because the lids 27*a*, 27*b* are provided to the left and right sides of the nozzle regions 7*a*, 7*b*, surface tension of the ink against the lids 27*a*, 27*b* suppresses downward movement of the ink through the ink absorbing members 26*a*, 26*b* so that ink will be absorbed more uniformly throughout the ink absorbing members 26*a*, 26*b*. As a result, the ink absorbing members 26*a*, 26*b* will be able to hold more ink. The lids 27*a*, 27*b* are equally effective for preventing ink from splattering during a flushing operation of a print head 7 as for preventing ink from overflowing from the caps 25*a*, 25*b*. It should be noted that the lids 27*a*, 27*b* need not cover the entire the ink-ejection-surface confronting surface of the ink absorbing members 26*a*, 26*b*. For example, even if lids are provided that cover only the lower half or even less of the ink-ejection-surface confronting surface of the ink absorbing members 26*a*, 26*b*, except of course the nozzle-region-confronting portion of the ink absorption members 26*a*, 26*b*, then the above-described effects can still be achieved: ink can be properly dammed up by the lids and also surface tension of the ink against the lids 27*a*, 27*b* will suppress downward movement of the ink through the ink absorbing members 26*a*, 26*b*. However, the effects of the present invention are most striking when the lids 27*a*, 27*b* cover the entire the ink-ejection-surface confronting surface of the ink absorbing members 26*a*, 26*b*, except the nozzle-region-confronting portion of the ink absorption members 26*a*, 26*b*.

As mentioned above, when ink is sucked from the nozzles, then the corresponding or both ink absorption members 26*a*, 26*b* disposed in the caps 25*a*, 25*b*, respectively, first absorb the ink, then the pump 21 sucks the ink from the ink absorbing members 26*a*, 26*b* through the suction portions 28*a*, 28*b* and collects the ink through the corresponding suction port 28*a* or 28*b*. Because ink that was absorbed by the ink absorption members 26*a*, 26*b* is sucked out through the suction ports 28*a*, 28*b*, ink can be even more effectively prevented from overflowing from the caps 25*a*, 25*b*. The performance of the print head 7 can be properly maintained and overflow of ink from the caps 25*a*, 25*b* can be even more properly prevented.

When the ink ejection surface of the print head is oriented in any direction but in parallel with the horizontal direction, then ink will accumulate most easily at the portion of the ink absorption members 26*a*, 26*b* that is lower than others with respect to horizontal. In this case, it is desirable to locate the suction ports 28*a*, 28*b* below the ink absorption members 26*a*, 26*b*, for example, in the lowest edge of the caps 25*a*, 25*b*, so that ink can be sucked out and removed from the ink absorption members 26*a*, 26*b* with extreme efficiency. The same effect can be achieved by locating the suction ports 28*a*, 28*b* where ever ink is most likely to accumulate.

Because the lids 27*a*, 27*b* are formed with holes disposed in opposition with the nozzle regions 7*a*, 7*b*, the ink jet printer can perform the same ink absorption operations as a conventional ink jet printer. Also, the lids 27*a*, 27*b* operate especially effectively when the ink jet printer 1 is reclined on its side so that the caps 25*a*, 25*b* face upward. That is, even when the ink jet printer 1 is reclined on its side, there will be situations where the ink jet printer 1 will be in a tilted condition for some reason. Even when the ink jet printer 1 is disposed at a slant for some reason, the lids 27*a*, 27*b* prevent ink from overflowing from the ends of the caps 25*a*, 25*b* that is lowest because of the tilt. Moreover, because the lids 27*a*, 27*b* surround the nozzle regions 7*a*, 7*b* entirely, ink leaks from the caps 25*a*, 25*b* can be prevented regardless of which direction the ink jet printer tilts.

Figure 16:
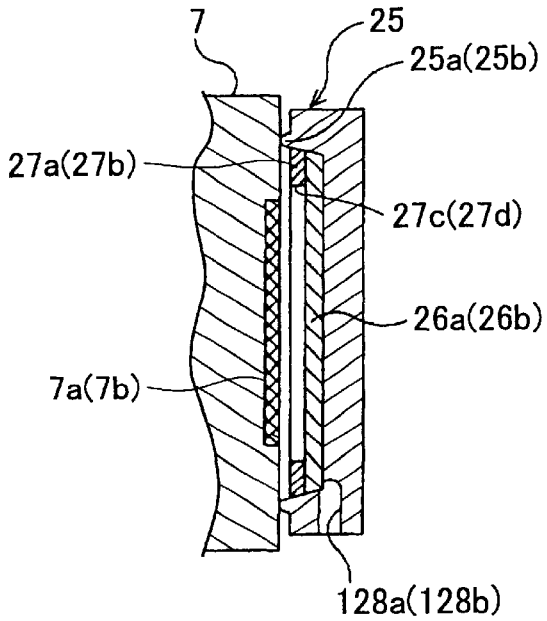
FIG. 16 is a cross-sectional view showing a modification of the cap unit of FIG. 15.

The configuration of the caps 25*a*, 25*b* can be modified as shown in FIG. 16. In this modification, suction ports 128*a*, 128*b* are opened in the lower end of the caps 25*a*, 25*b*. This modification achieves substantially the same effects as when the suction ports 28*a*, 28*b* are positioned as in the embodiment. The suction ports can be positioned as best suits the layout of the ink jet printer, so that freedom of design is increased.

Figure 17:
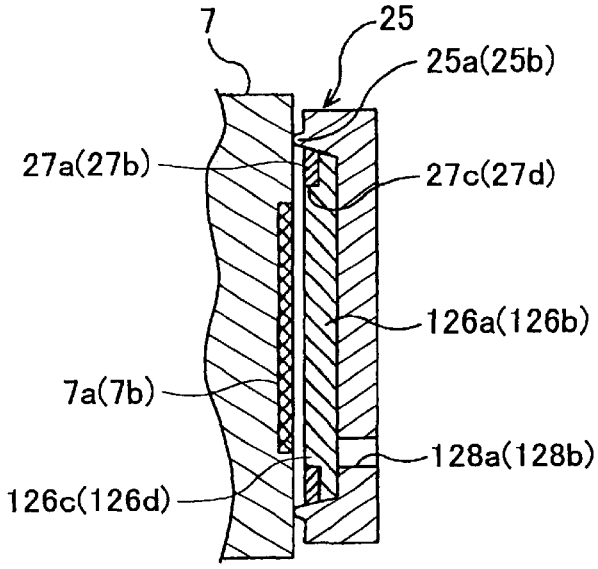
FIG. 17 is a cross-sectional view showing another modification of the cap unit of FIG. 15.

The configuration of the caps 25*a*, 25*b* can be also modified as shown in FIG. 17. In this modification, ink absorption members 126*a*, 126*b* are formed with protrusions 126*c*, 126*d* that protrude into the holes 27*c*, 27*d*, but not far enough to contact the ink ejection surface of the print head 7 when the caps 25*a*, 25*b* are in an intimate seal with the ink ejection surface of the print head 7. With this configuration, the ink absorption members 126*a*, 126*b* have a greater volume for absorbing ink so that the ink absorbing effects of the ink absorption members 26*a*, 26*b* can be increased and ink can be even more effectively prevented from spilling out from the caps 25*a*, 25*b*.

The ink jet printer 1 performs the above-described suction operations at a predetermined timing in order to recover ink ejection precision of the print head 7, or when the ink cartridge 17*a* or 17*b* is exchanged in order to introduce ink initially into the print head 7. As mentioned previously, an atmosphere communication hole 17*c* shown in FIG. 4 is formed in the outer side surface of the rigid casing of each of the ink cartridges 17*a*, 17*b*. Air from the ambient atmosphere is introduced through the atmosphere communication hole 17*c* so that ink can be smoothly supplied from the ink cartridges 17*a*, 17*b* to the print head 7 when various suction operations and the flushing operation is performed.

As shown in FIG. 4, the ink jet printer further includes a leak-prevention mechanism 80 for sealing closed the atmosphere communication hole 17*c*. The leak-prevention mechanism 80 includes a plug 81, a coil spring 83, and a solenoid 85. The plug 81 is disposed in confrontation with the atmosphere communication hole 17*c*. The coil spring 83 urges the plug 81 in the direction for sealing the atmosphere communication hole 17*c* closed. The solenoid 85 includes an operation shaft for moving the plug 81 against the urging force of the coil spring 83 in order to release the sealed condition between the plug 81 and the atmosphere communication hole 17*c*.

Figure 18:
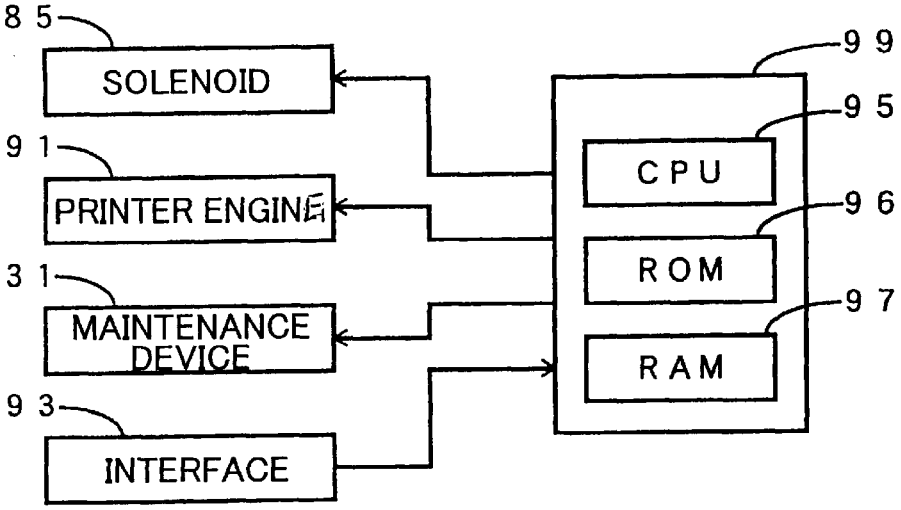
FIG. 18 is a block diagram showing a control system of the ink jet printer.

As shown in FIG. 18, the ink jet printer 1 further includes an electric control circuit 99, a printer engine 91, and an interface 93. The electric control circuit 99 is electrically connected to the maintenance device 31, the solenoid 85, the printer engine 91, and the interface 93. The electric control circuit 99 is a microcomputer including a central processing unit (CPU) 95, a read only memory (ROM) 96, and a random access memory (RAM) 97. The printer engine 91 includes the carriage motor 5, the print head 7, and a drive system for driving the various rollers described above. The interface 93 is for inputting a variety of data relating to image formation from an external device. The electric control circuit 99 drives the printer engine 91 based on data input from the interface 93 and also executes processes for driving the maintenance device 31 at a predetermined timing.

The electric control circuit 99 detects whether or not a command signal commanding an ink ejection or suction operation has been input over the interface 93 and controls the printer engine 91, the maintenance device 31, or both accordingly to eject ink from or suck ink from the print head 7 based on the input command signal. The electric control circuit 99 also operates to turn on the solenoid 85 only when such a signal is detected. In other words, the electric control circuit 99 only turns on the solenoid 85, and consequently opens up the atmosphere communication hole 17*c*, while the different suction operations and ink ejection operations for flushing and for image formation are being executed, because there is only a need to open the atmosphere communication hole 17*c* when a command is received to suck or eject ink from the print head 7. According to the present invention, ink ejection operations encompass all operations for ejecting ink from the print head 7, such as normal ink ejection for forming images and flushing operations for recovering the ink ejection properties of the print head 7. Further, suction operations encompass all operations for sucking ink from the print head 7, including suction operations for sucking ink from the print head 7 to recover the ink ejection properties of the print head 7 and suction operations for sucking ink initially into the print head 7 after an empty ink cartridge is exchanged for a new one. In this way, the electric control circuit 99 controls the leak prevention mechanism 80 to seal shut and open up the atmosphere communication hole 17*c* in accordance with progress of the suction and ejection operations. For this reason, ink can be sucked and ejected from the print head 7 even more reliably.

On the other hand, the electric control circuit 99 turns off the solenoid 85, and consequently seals closed the atmosphere communication hole 17*c*, at all times other than when the different suction and ink ejection operations for maintenance of the print head 7 and for image formation are being executed. With this configuration, ink leaks from the print head 7 can be properly prevented when ever no ink needs to be supplied from the ink cartridges 17*a*, 17*b* to the print head 7.

The atmosphere communication hole 17*c* is unsealed only when needed during suction or ejection operations so that ink can be smoothly supplied from the ink cartridges 17*a*, 17*b* to the print head 7. At all other times, the atmosphere communication hole 17*c* is sealed shut so that supply of ink can be suppressed. By suppressing the supply of ink, ink can be properly prevented from leaking from the print head 7 when the ink jet printer is being transported, when the power supply is turned off, and during all other situations where there is no need to supply ink from the ink cartridges 17*a*, 17*b* to the print head 7.

Also, the electric control circuit 99 can execute the following control during the various suction operations described above. When the electric control circuit 99 detects a signal that commands that ink be sucked from the print head 6 for example, the electric control circuit 99 drives the pump 21 while the atmosphere communication hole 17*c* is sealed shut until a certain amount of negative pressure develops in the caps 25*a*, 25*b*, and then drives the solenoid 85 to unseal the atmosphere communication hole 17*c*. As a result, ink is rapidly sucked into the caps 25*a*, 25*b* when the sealed condition of the atmosphere communication hole 17*c* is released so that suction operations can be executed that much more reliably, because the seal of the atmosphere communication hole 17*c* is released while ink in the entire ink supply pathway from the ink holding bags 17*d* to the print head 7 is applied with a negative pressure. That is, a negative pressures is applied not only the ink in the print head 7, but also to the ink in the tubes 15 and further to the ink in the ink-holding bags 17*d*. Therefore, the ink-holding bags 17*d* disposed within the ink cartridges 17*a*, 17*b* are rapidly compressed at the instant that the seal of the atmosphere communication hole 17*c* is released. Air mixed in the tubes 15 can be easily and reliably sucked out with the ink.

Next, modifications of the leak prevention mechanism 80 will be described with reference to FIGS. 19 to 23.

Figure 19:
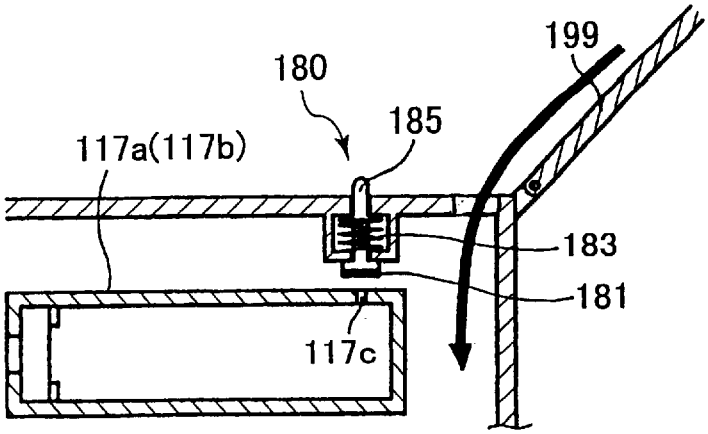
FIG. 19 is a cross-sectional view showing a modification of the leak-preventing mechanism of the embodiment.

In the modification shown in FIG. 19, ink cartridges 117*a*, 117*b*, which are each formed with an atmosphere communication hole 117*c*, are disposed at the upper side of the printer housing directly under a freely openable and closable cover 199. The cover 199 serves as a tray for transporting sheets through and opening in the casing as indicated by an arrow in FIG. 19. To achieve this function, the cover 199 is in an opened condition while printer operations are being performed. A leak prevention mechanism 180 for preventing leaks from the atmosphere communication hole 117*c* includes a plug 181, a coil spring 183, and an operation shaft 185. The coil spring 183 urges the plug 181 in the direction for sealing off the atmosphere communication hole 117*c*. The operation shaft 185 is contacted by the cover 199 when the cover 199 is closed shut. As a result, when the cover 199 is closed shut and pressed down on the contactor 199, the contactor 199 and the plug 181 slide down against the urging force of the coil spring 183 and seals the atmosphere communication hole 117*c* tight.

The ink jet printer is normally transported around while the cover 199 is shut closed. Because the atmosphere communication hole 117*c* is sealed closed when the cover 199 is shut closed, the atmosphere communication hole 117*c* will be sealed closed at least while the ink jet printer is being carried around. In the modification of FIG. 19, the operation shaft 185 serves as an opening condition detector that detects the opened/closed condition of the cover 199. However, in situations when the operation shaft 185 cannot be operated directly by the cover 199, then a sensor can be provided for detecting the opened/closed condition of the cover 199. In this case, the solenoid 85 described in the embodiment can be used to operate the plug 181 based on the detection result of the sensor. Although the cover 199 essentially functions to be opened while the printer is being used and to be closed while the printer is being transported around, the cover 199 can also serve as a sheet-transport tray, a discharge tray, or simply to prevent dust and the like from getting into the ink jet printer.

Figure 20:
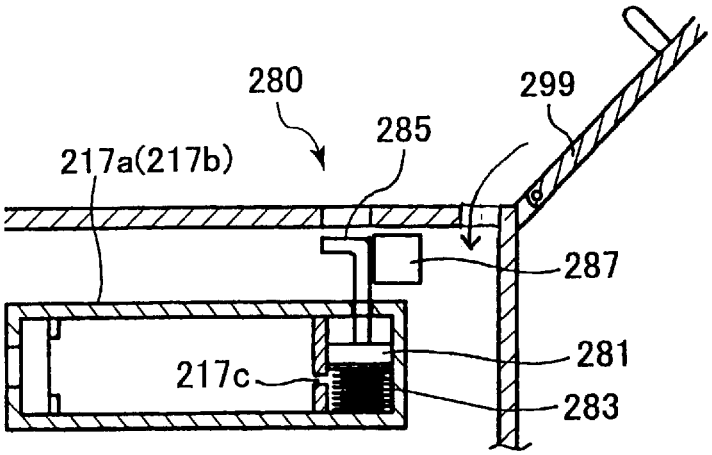
FIG. 20 is a cross-sectional view showing another modification of the leak-preventing mechanism.

In the modification shown in FIG. 20, ink cartridges 217*a*, 217*b* include an atmosphere communication hole 217*c* disposed within the rigid cartridge case. The cover 299 also serves as a tray for transporting sheets through and opening in the casing as indicated by an arrow in FIG. 20. To achieve this, the cover 299 of the ink jet printer is in an opened condition while printer operations are being performed. In this case, a leak prevention mechanism 280 includes a plug 281, a coil spring 283, an operation shaft 285, and a sensor 287. The plug 281, the coil spring 283, and the operation shaft 285 are disposed in the ink cartridges 217*a*, 217*b*. The sensor 287 detects movement of the operation shaft 285 and so can detect when an ink cartridge without the operation shaft 285 is mounted in the ink jet printer. In such a case, the control system of the ink jet printer 1 can perform operations to limit use, because ink leaks cannot be prevented in this case even when the cover 299 is closed shut.

Also, specific information about the ink cartridges 217*a*, 217*b* can be provided on the operation shaft 185 in a form that is optically, magnetically, or otherwise readable by the sensor 287. When an ink cartridge that is not meant to be used for a particular purpose is mounted in the ink jet printer 1, this configuration can prevent the ink cartridge from being used for the wrong purpose. For example. If an empty cartridge is mistakenly remounted in the ink jet printer 1 after being removed, its use can be restricted.

Figure 21:
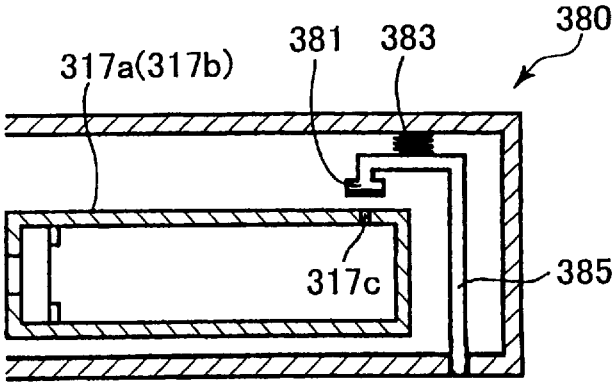
FIG. 21 is a cross-sectional view showing another modification of the leak-preventing mechanism.

In the modification shown in FIG. 21, ink cartridges 317*a*, 317*b* are each provided with an atmosphere communication hole 317*c*. A leak prevention mechanism 380 includes a plug 381, a coil spring 383, and an operation shaft 385. The operation shaft 385 slides integrally with movement of the plug 381. The lower end of the operation shaft 385 is mounted in a through hole in the lower surface of the ink jet printer housing. The coil spring 383 urges the operation shaft 385 downward to protrude out through the hole in the ink jet printer housing. When the ink jet printer is placed on a flat surface, the operation shaft 385 is pressed upward against the urging force of the coil spring 383 so that the plug 381 is moved away from the atmosphere communication hole 317*c*. The ink jet printer is used while placed on a flat surface, such as a desk top, but not placed on a flat surface when carried around or otherwise transported. Therefore, when the ink jet printer is not placed on a flat surface, the lower end of the operation shaft 385 can protrude from the lower surface of the ink jet printer housing under the urging force of the coil spring 383 so that the plug 381 seals the atmosphere communication hole 317*c* shut. As a result, the atmosphere communication hole 317*c* will be sealed shut at least while the ink jet printer is being carried.

With this configuration, the atmosphere communication hole 317*c* can be properly sealed shut even if the ink jet printer is unstable when placed on a desktop surface, for example, because the ink jet printer is slightly raised from the desktop surface by being placed on top of documents and the like that are scattered on the desktop surface. As a result, ink leaks from the print head 7 caused by vibration, shock, and the like can be that much more effectively prevented.

Figure 22:
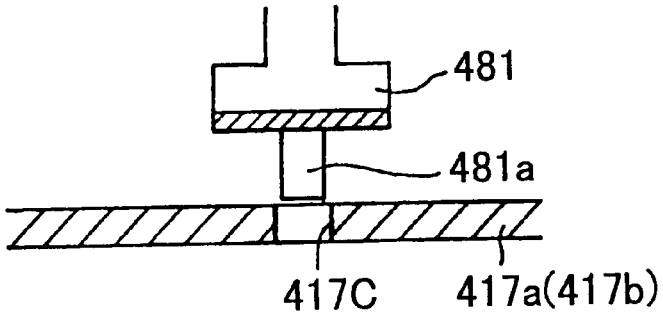
FIG. 22 is a cross-sectional view showing another modification of the leak-preventing mechanism.

In the modification shown in FIG. 22, a plug 481 for sealing an atmosphere communication hole 417*c* of ink cartridges 417*a*, 417*b* is provided with a protrusion 481*a* facing toward the atmosphere communication hole 417*c*. With this configuration, the ink cartridges 417*a*, 417*b* cannot be removed while the plug 481 seals the atmosphere communication hole 417*c* closed. As a result, the ink cartridges 417*a*, 417*b* can be maintained at a desired mounting position while the ink jet printer is picked up, carried around, moved, or otherwise transported.

Figure 23:
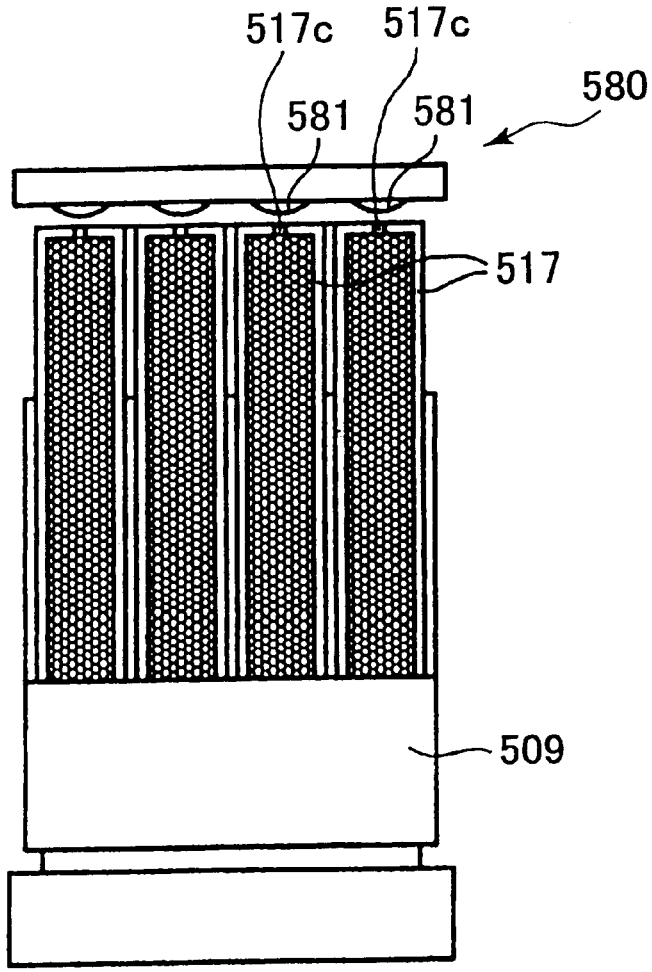
FIG. 23 is a cross-sectional view showing another modification of the leak-preventing mechanism.

The ink jet printer of the modification shown in FIG. 23 includes ink cartridges 517 that are mounted directly on a carriage 509, rather than being connected to the print head by tubes as described in the embodiment. As shown, a leak prevention mechanism 580 includes a plug set 581 disposed in confrontation with atmosphere communication holes 517*c* of the ink cartridges 517. The plug set 581 can be moved toward and away from the ink cartridges 517 by any of the configurations described above to achieve the same effects as the embodiment and its modifications.

In this way, the present invention can be applied to a variety of different ink jet printers. However, it should be that the effects of the present invention are more striking when the present invention is applied to the type of ink jet printer described in the embodiment, that is, wherein ink held in a flexible ink bag is supplied to the print head through tubes. An ink jet printer that supplies ink through tubes is more likely to leak ink from the print head during transport of the ink jet printer than the type of ink jet printer shown in FIG. 23, that is, the type wherein ink is supplied directly from the ink cartridge to the print head. Accordingly, a printer that supplies ink through tubes can be effectively prevented from leaking ink from the print head while carrying the ink jet printer around by sealing the atmosphere communication hole that brings the inside the rigid cartridge case into fluid communication with atmosphere.

While the invention has been described in detail with reference to specific embodiments thereof, it would be apparent to those skilled in the art that various changes and modifications may be made therein without departing from the spirit of the invention, the scope of which is defined by the attached claims.

For example, the solenoid 85 can be connected directly to the main power supply of the ink jet printer so that the solenoid 85 operates to move the plug 81 to seal the atmosphere communication hole 17*c* when the power supply is turned off. A user will normally turn off the power supply before moving the ink jet printer. By connecting the solenoid 85 directly to the main power supply in this manner, ink can be properly prevented from leaking from the print head 7 when the ink jet printer is being carried around. The main power supply of the ink jet printer is often turned off in other situations as well. For example, the operator often turns off the main power of the ink jet printer before leaving the room where the ink jet printer is located. Even if the ink jet printer is shaken or shocked while the user is away, by an earthquake for example, ink will be prevented from leaking out of the atmosphere communication hole 17*c* because the plug 81 will seal the atmosphere communication hole 17*c* if the power is turned off.

Also, although the operation shafts 185, 285, 385 themselves serve as detectors for detecting whether the cover of the ink jet printer is opened or closed, or whether the ink jet printer is placed on a flat surface or being carried around, other types of sensors can be provided to detect movement of the operation shafts 185, 285, 385. Further, a variety of sensors can be used to detect whether the ink jet printer is placed on a flat surface or being moved, so that the atmosphere communication hole can be sealed closed based on the detection results. For example, a level, G sensor (acceleration sensor), or a global positioning system (GPS) sensor can be used. Further, the leak prevention mechanisms described above can be modified to seal the atmosphere communication hole in the ink cartridge when no recording sheets are set in the sheet-supply tray. Also, the leak prevention mechanisms described in the embodiment and its modifications can be combined in various ways to produce a configuration that seals an atmosphere communication hole closed when two or more of the above-described conditions are met or when one of two or more of the above-described conditions are met.

What is claimed is:

1. A cap device for capping a head of an ink jet printer, the head having an ink ejection surface formed with nozzles, the cap device comprising:

a cap for developing a seal around the ink ejection surface of the head;

an ink absorption member disposed in the cap to absorb ink that was ejected or sucked from the head into the cap; and a lid that covers an ink-ejection-surface-confronting portion of the ink absorption member except at least a nozzle-confronting portion of the ink absorption member, the lid being connected to an inner peripheral surface of the cap with a fluidly tight connection.

2. A cap device as claimed in claim 1, wherein the lid covers the entire ink-ejection-surface-confronting portion of the absorption member except the nozzle-confronting portion of the ink absorption member.

3. A cap device as claimed in claim 1, wherein the cap includes a suction port through which ink absorbed in the ink absorption member is sucked out and removed from the ink absorption member, the suction port being located in a portion of the cap where ink most easily accumulates in the ink absorption member.

4. A cap device as claimed in claim 3, wherein the ink ejection surface of the head is oriented in any direction but horizontal, the suction port being formed in a portion of the cap that is lower than other portions of the cap with respect to horizontal.

5. A cap device as claimed in claim 3, further comprising a negative pressure generating unit connected to the suction port, the negative pressure generating unit generating a negative pressure that is applied, through the suction port, to an inner space defined by the cap and the ink ejection surface of the head when the cap develops a seal around the ink ejection surface of the head.

6. A cap device as claimed in claim 1, wherein the lid has a hole at the nozzle-confronting portion of the ink absorption member and the ink absorption member has a protrusion that protrudes into the hole in the lid by an amount insufficient for the protrusion to contact the ink ejection surface of the head when the cap develops a seal around the ink ejection surface of the head.

7. An ink jet printer comprising:

a head having an ink ejection surface formed with nozzles;

a cap for developing a seal around the ink ejection surface of the head;

an ink absorption member disposed in the cap to absorb ink that was ejected or sucked from the head into the cap; and a lid that covers an ink-ejection-surface-confronting portion of the ink absorption member except at least a nozzle-confronting portion of the ink absorption member, the lid being connected to an inner peripheral surface of the cap with a fluidly tight connection.

8. An ink jet printer as claimed in claim 7, further comprising:

an ink cartridge for holding ink supplied to the head, the ink cartridge being formed with an atmosphere communication hole for facilitating supply of ink to the head; and a communication hole sealing unit that selectively seals the atmosphere communication hole at least while the ink jet printer is being transported.

9. An ink jet printer as claimed in claim 8, further comprising:

a cover that is opened while print operations are being performed; and a cover-condition detector that detects whether the cover is closed, the communication hole sealing unit operating to seal the atmosphere communication hole when the detector detects that the cover is closed.

10. An ink jet printer as claimed in claim 8, further comprising:

a housing that houses at least the head; and a placement detector that detects whether the housing is placed on a surface, the communication hole sealing unit unsealing the atmosphere communication hole when the detector detects that the housing is placed on a surface.

11. An ink jet printer as claimed in claim 8, further comprising:

a power supply for supplying power to at least the head; and a power supply condition detector that detects whether the power supply is turned off, the communication hole sealing unit sealing the atmosphere communication hole while the power supply condition detector detects that the power supply is turned off.

12. An ink jet printer as claimed in claim 8, further comprising:

a suction unit that sucks ink from the head based on input of an ink suction command signal; and a signal detector that detects whether an ink suction command signal was input, the communication hole sealing unit sealing the atmosphere communication hole unless the signal detector detects input of an ink suction command signal.

13. An ink jet printer as claimed in claim 12, wherein the communication hole sealing unit seals or unseals the atmosphere communication hole in accordance with operations performed by the suction unit when the signal detector detects input of an ink suction command signal.

14. An ink jet printer as claimed in claim 8, further comprising:

an ink ejection unit that ejects ink from the head based on input of an ejection command signal; and a signal detector that detects whether an ink ejection command signal was input, the communication hole sealing unit sealing the atmosphere communication hole unless the signal detector detects input of an ink ejection command signal.

15. An ink jet printer as claimed in claim 8, further comprising a flexible tube connecting the ink cartridge with the head for supplying ink from the ink cartridge to the head, the ink cartridge including:

a stiff housing formed with the atmosphere communication holes for bringing an inside of the housing into fluid communication with atmosphere;

a flexible bag housed in the housing and holding ink, ink being supplied from the flexible bag, through the flexible tube, to the head when the communication hole sealing unit unseals the atmosphere communication hole.

16. A cap device for capping a head of an ink jet printer, the head having an ink ejection surface formed with nozzles, the cap device comprising:

a cap having a base and an inner peripheral surface, the base and the inner peripheral surface defining an inner space and an open side of the cap, the open side being in confrontation with the base, the cap developing a seal around the ink ejection surface of the head when the cap is in intimate contact with the head while the head is located at the open side;

an ink absorption member disposed at the base of the cap to absorb ink that was ejected or sucked from the head into the cap from the open side of the cap, the ink absorption member having an upper surface facing the open side of the cap from inside the cap, the upper surface having an nozzle-confronting portion at a position that confronts the nozzles of the head when the cap is in an intimate seal with the ink ejection surface of the head; and a lid that covers the upper surface of the ink absorption member except at least the nozzle-confronting portion of the upper surface, the lid being connected to the inner peripheral surface of the cap with a fluidly tight connection.

* * * * *